US010011327B2

(12) United States Patent
Sato et al.

(10) Patent No.: US 10,011,327 B2
(45) Date of Patent: Jul. 3, 2018

(54) WATERCRAFT

(71) Applicant: YAMAHA HATSUDOKI KABUSHIKI KAISHA, Iwata, Shizuoka (JP)

(72) Inventors: Hideyoshi Sato, Newman, GA (US); Jonathan Debow, Newman, GA (US)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 118 days.

(21) Appl. No.: 15/220,786

(22) Filed: Jul. 27, 2016

(65) Prior Publication Data

US 2018/0029672 A1 Feb. 1, 2018

(51) Int. Cl.

| | |
|---|---|
| ***B63H 11/02*** | (2006.01) |
| ***B63B 25/00*** | (2006.01) |
| ***B63B 35/73*** | (2006.01) |
| *B63B 29/04* | (2006.01) |
| *B63H 25/02* | (2006.01) |

(52) U.S. Cl.

CPC ..... *B63B 25/002* (2013.01); *B63B 35/731* (2013.01); *B63H 11/02* (2013.01); *B63B 2029/043* (2013.01); *B63B 2718/00* (2013.01); *B63H 2025/024* (2013.01)

(58) Field of Classification Search

CPC ..... B63B 25/02; B63B 35/731

USPC ..... 114/55

See application file for complete search history.

(56) References Cited

U.S. PATENT DOCUMENTS

| | | | | |
|---|---|---|---|---|
| 3,552,349 | A * | 1/1971 | Snow | B63B 35/731 114/288 |
| 5,095,843 | A * | 3/1992 | Kobayashi | B63B 35/731 114/360 |
| 5,520,133 | A * | 5/1996 | Wiegert | B63B 35/731 114/125 |
| 5,584,733 | A * | 12/1996 | Kobayashi | B63B 35/731 440/111 |
| 6,145,458 | A * | 11/2000 | Hattori | B63B 29/04 114/55.57 |
| 6,276,290 | B1 * | 8/2001 | Yamada | B63B 19/14 114/55.51 |
| 6,553,928 | B2 * | 4/2003 | Yamada | B63B 19/14 114/55.51 |
| 6,626,124 | B2 * | 9/2003 | Nakajima | B63B 25/002 114/343 |
| 6,668,742 | B2 * | 12/2003 | Nadeau | B63B 25/002 114/55.5 |

(Continued)

FOREIGN PATENT DOCUMENTS

JP 10-119882 A 5/1998

*Primary Examiner* — Samuel J Morano, IV
*Assistant Examiner* — Jovon E Hayes

(57) ABSTRACT

A watercraft is provided with a watercraft body and a storage container. The watercraft body includes a hull and a deck. The deck is provided on the hull. The storage container is attached to the watercraft body. The storage container includes an access opening and an annular sidewall. The access opening opens upward relative to the deck. The annular sidewall has an upper end, a lower end and an interior storage space between the upper end and the lower end. The lower end of the annular sidewall defines a bottom opening with a cross sectional area that is larger than a cross sectional area of the upper end of the annular sidewall.

21 Claims, 17 Drawing Sheets

(56) References Cited

U.S. PATENT DOCUMENTS

| | | | | |
|---|---|---|---|---|
| 6,681,712 | B1 * | 1/2004 | Andreae | B63B 9/00 114/343 |
| 6,699,085 | B2 * | 3/2004 | Hattori | B63H 21/213 114/55.5 |
| 6,892,666 | B1 * | 5/2005 | Plante | B63B 35/731 114/363 |
| 6,895,880 | B2 * | 5/2005 | Nakajima | B63B 19/12 114/55.51 |
| 7,186,154 | B2 * | 3/2007 | Takashima | B63J 99/00 114/55.51 |
| 7,380,512 | B2 * | 6/2008 | Curtin | B63B 19/14 114/55.53 |
| 8,261,683 | B2 * | 9/2012 | Knoblett | B63B 29/04 114/363 |
| 8,505,475 | B2 * | 8/2013 | Otsuka | B63B 49/00 114/55.5 |
| 8,720,355 | B2 * | 5/2014 | Aoyama | B63B 17/00 114/343 |
| 8,899,169 | B1 * | 12/2014 | Jaziri | B63B 19/16 114/363 |
| 9,032,891 | B2 * | 5/2015 | Kinoshita | B63B 17/00 114/343 |
| 9,079,638 | B2 * | 7/2015 | Ricciardi | B63B 29/04 |
| 2001/0000052 | A1 * | 3/2001 | Yamada | B63B 19/14 114/55.53 |

* cited by examiner

WATERCRAFT

BACKGROUND

Field of the Invention

The present invention generally relates to the field of watercrafts. More specifically, the present invention relates to a storage container of a watercraft.

Background Information

Some watercrafts are provided with a storage container or storage compartments for various storing items of the rider. The storage container or storage compartment has an access opening that communicates with an interior storage space. Typically, the access opening is opened and closed by a lid. Storage containers or storage compartments are provided at various locations on the watercraft. One example of a large watercraft having a storage compartment provided behind a seat back is disclosed in U.S. Pat. No. 9,079,638.

In some watercrafts the storage container is located near the steering area of the watercraft so that the items in the storage container are readily accessible. Two examples of personal watercrafts having a storage container disposed between the handle and the seat are disclosed in U.S. Pat. No. 9,032,891 and Japanese Unexamined Patent Application Publication No. H10-119882. Further, U.S. Pat. No. 9,032,891 discloses a personal watercraft having storage containers located in front of the steering area and beneath a saddle seat.

SUMMARY

Generally, the present disclosure is directed to various storage features of a watercraft, especially a jet-powered watercraft such as a personal watercraft (PWC). In watercrafts, storage containers are often provided beneath a body panel of the watercraft body. The storage capacity of such a storage container is typically limited by the dimensions of an installation opening in the body panel of the watercraft body. Depending on the configuration of the watercraft, the installation opening in the body panel of the watercraft body is often small while the potential storage area beneath the installation opening in the body panel of the watercraft body can be larger than the area of the installation opening.

This lack of storage due to the watercraft body configuration is especially a problem in the case of a personal watercraft. A personal watercraft is a small, jet-powered watercraft that resembles a snowmobile in appearance having a handlebar and a straddle seat, and that is designed to be operated on water by a person sitting, standing, or kneeling on the vessel. Since personal watercrafts are relatively small water vessels, typically, the personal watercraft has very little amount of storage. In the case of a personal watercraft, an ideal location of a storage container is in front of the rider's seat. The area between the handlebar and the straddle seat is an especially convenient location for a storage container, since the user can access the storage while straddling the straddle seat. However, the area of the watercraft body between the handlebar and the straddle seat is quite limited, which also limits the storage capacity of the storage container.

One object of the present invention is to increase a storage capacity of a storage container regardless of the dimension of the installation opening for the storage container. In accordance with this object, a storage container is provided that includes an interior storage space having a bottom opening that is wider than an access opening.

In accordance with one aspect of the present disclosure, a watercraft is provided that basically comprises a watercraft body and a storage container. The watercraft body includes a hull and a deck. The deck is provided on the hull. The storage container is attached to the watercraft body. The storage container includes an access opening and an annular sidewall. The access opening opens upward relative to the deck. The annular sidewall has an upper end, a lower end and an interior storage space between the upper end and the lower end. The lower end of the annular sidewall defines a bottom opening with a cross sectional area that is larger than a cross sectional area of the upper end of the annular sidewall.

In accordance with another aspect of the present disclosure, a personal watercraft is provided that basically comprises a watercraft body, a handlebar, a straddle seat and a storage container. The watercraft body includes a hull and a deck. The deck is provided on the hull. The handlebar is rotatably disposed relative to the watercraft body. The straddle seat is disposed on the deck at a rearward location of the handlebar. The storage container is attached to the watercraft body. The storage container includes an access opening and an annular sidewall. The access opening opens upward relative to the deck. The annular sidewall has an upper end, a lower end and an interior storage space between the upper end and the lower end. The lower end of the annular sidewall defines a bottom opening with a cross sectional area that is larger than a cross sectional area of the upper end of the annular sidewall.

While the disclosed watercraft is a personal watercraft, some features of the disclosed watercraft can be used with other types of watercrafts. Thus, some features of the disclosed watercraft are not limited to personal watercraft.

Also other features, aspects and advantages of the disclosed watercraft will become apparent to those skilled in the field of manufacturing watercrafts from the following detailed description, which, taken in conjunction with the annexed drawings, discloses several illustrative embodiments of a watercraft with various features.

BRIEF DESCRIPTION OF THE DRAWINGS

Referring now to the attached drawings which form a part of this original disclosure.

Figure 1:
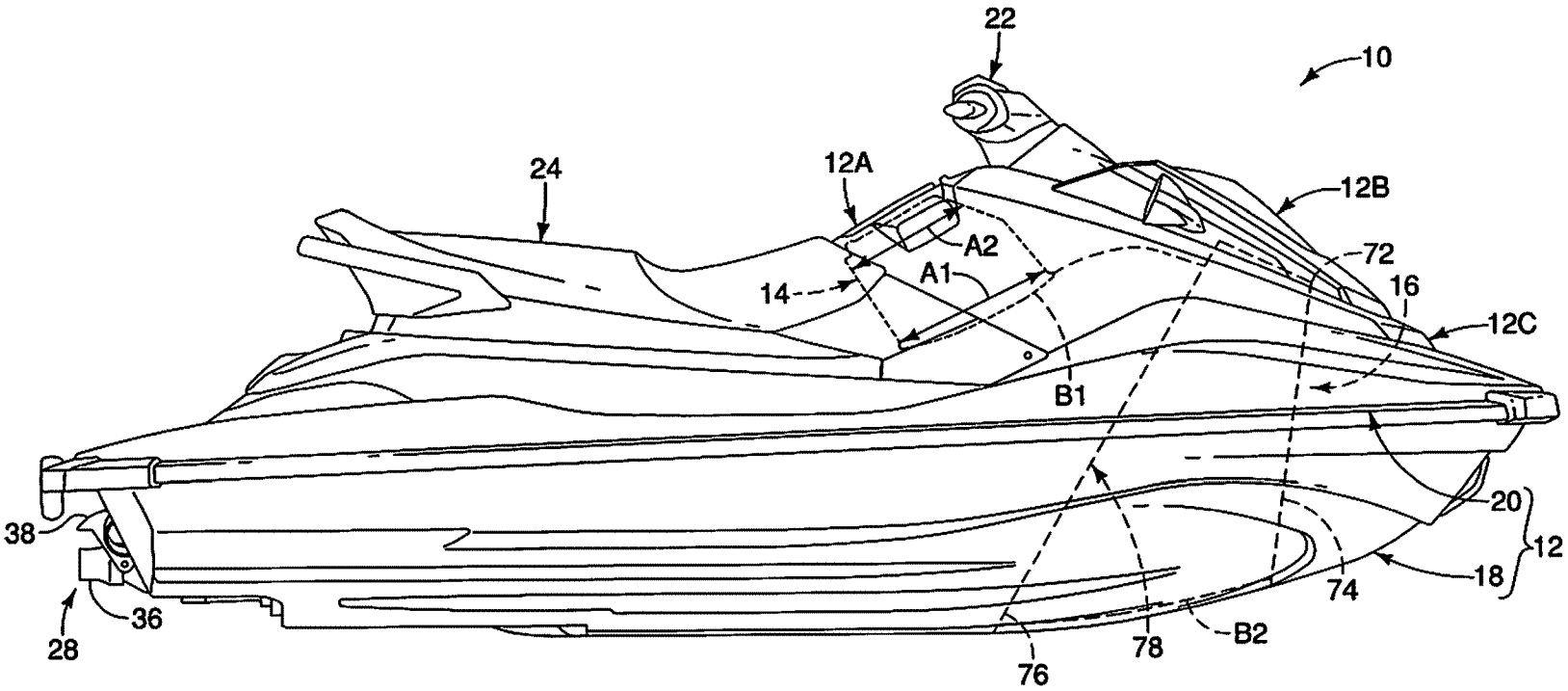
FIG. 1 is a right side (starboard) elevational view of a watercraft in the form of a personal watercraft (PWC) in accordance with one illustrative embodiment, in which a first storage container is provided between a handlebar and a straddle seat and a second storage container is provided in front of the handlebar, and in which lids of the first and second storage containers are closed.

It should be noted that these figures are intended to illustrate the general characteristics of methods, structure and/or materials utilized in certain illustrative embodiments and to supplement the written description provided below. These drawings are not to scale and may not precisely reflect the precise structural or performance characteristics of any given embodiment, and should not be interpreted as defining or limiting the range of values or properties encompassed by illustrative embodiments unless specified. However, the dimensional relationships of the storage containers as illustrated herein define one illustrative embodiment. The use of similar or identical reference numbers in the various drawings is intended to indicate the presence of a similar or identical element or feature.

DETAILED DESCRIPTION OF EMBODIMENTS

Selected embodiments will now be explained with reference to the drawings. It will be apparent to those skilled in the watercraft field from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features may be omitted in later embodiments.

Figure 2:
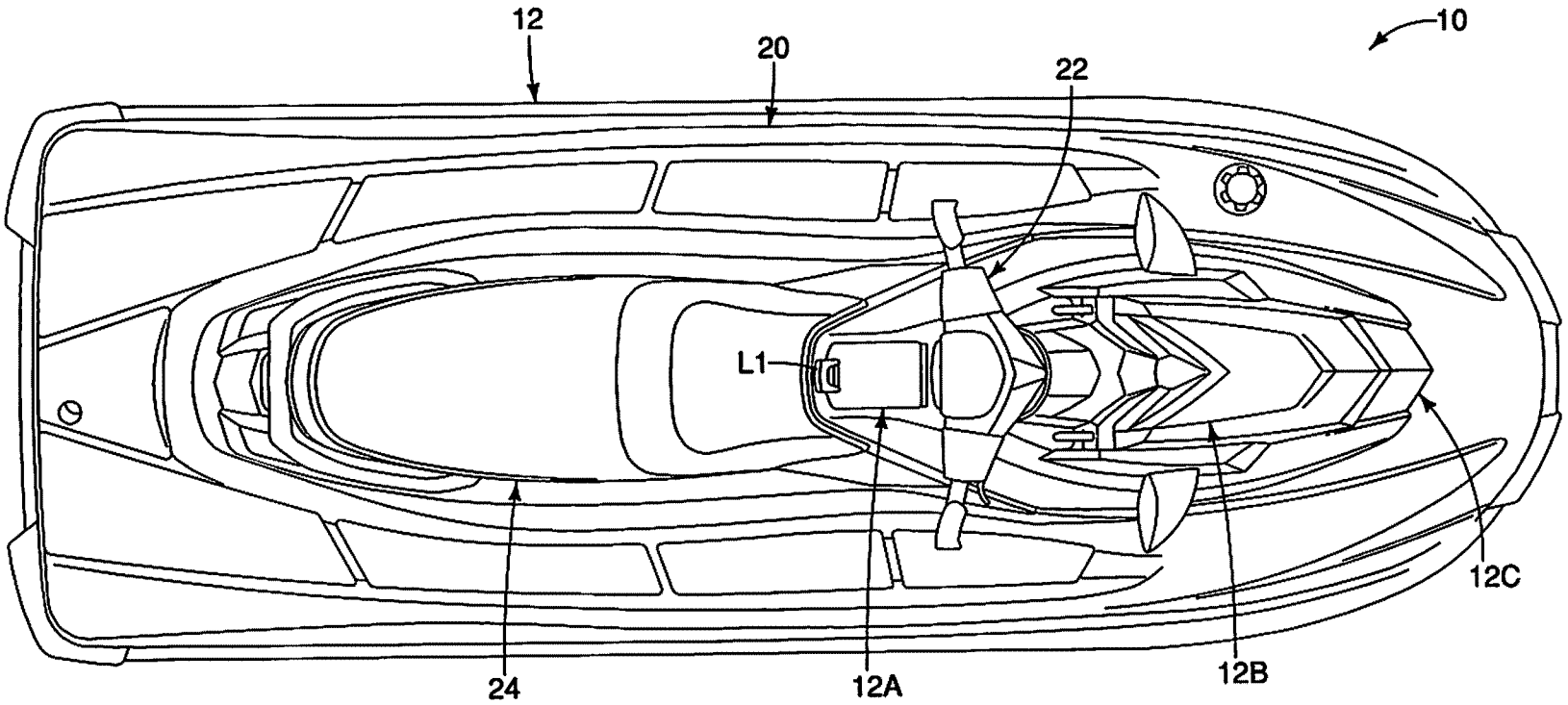
FIG. 2 is a top plan view of the personal watercraft illustrated in FIG. 1 in which the lids of the first and second storage containers are closed.
Figure 3:
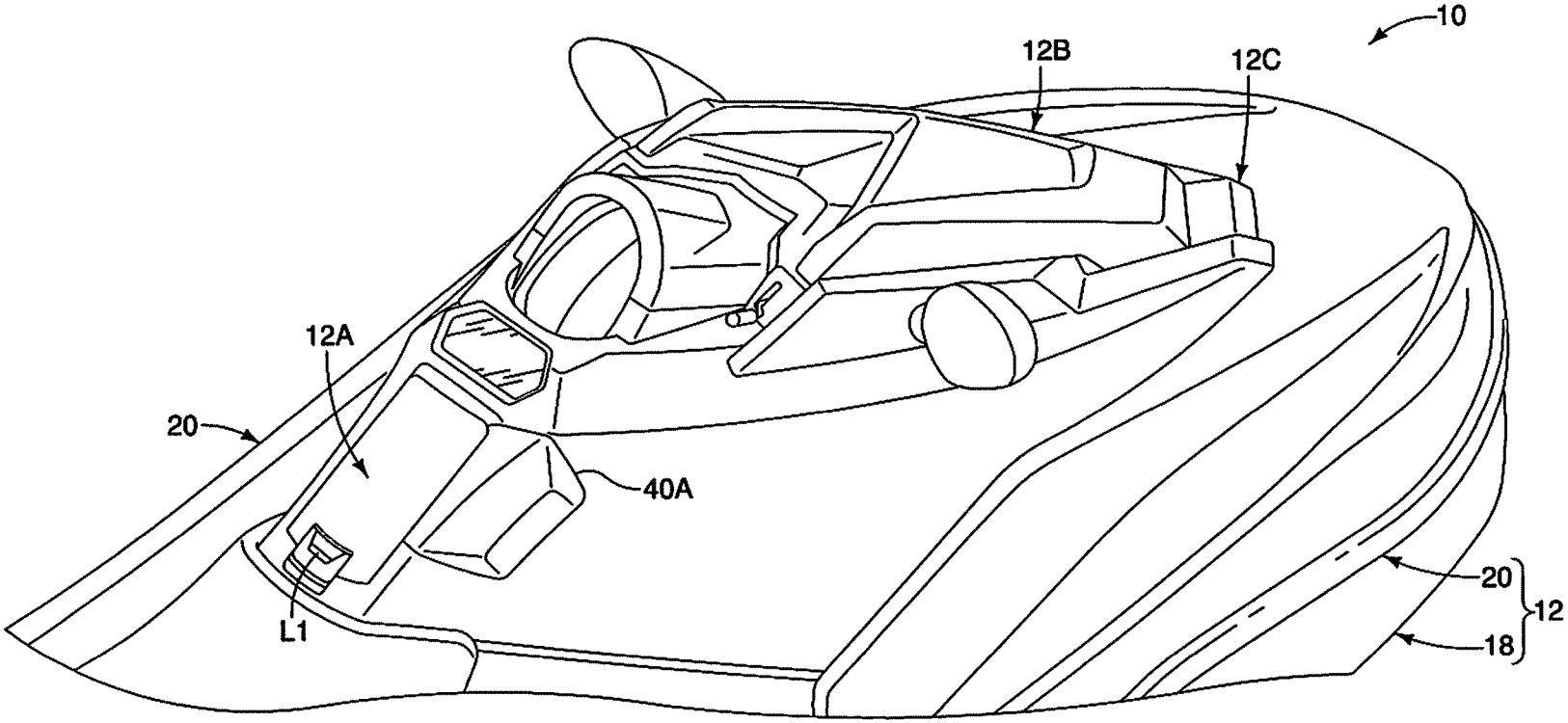
FIG. 3 is a rear perspective view of the personal watercraft illustrated in FIGS. 1 and 2 with the steering assembly removed to show the lids of the first and second storage containers are closed.

Referring initially to FIGS. 1 and 2, a watercraft 10 is illustrated in the form of a personal watercraft (PWC) in accordance with one illustrative embodiment. While the watercraft 10 is illustrated as a personal watercraft, it will be apparent to those skilled in the watercraft field from this disclosure that the watercraft 10 is not limited to this illustrated configuration of a personal watercraft. The present invention can be provided to other types of watercrafts.

Figure 4:
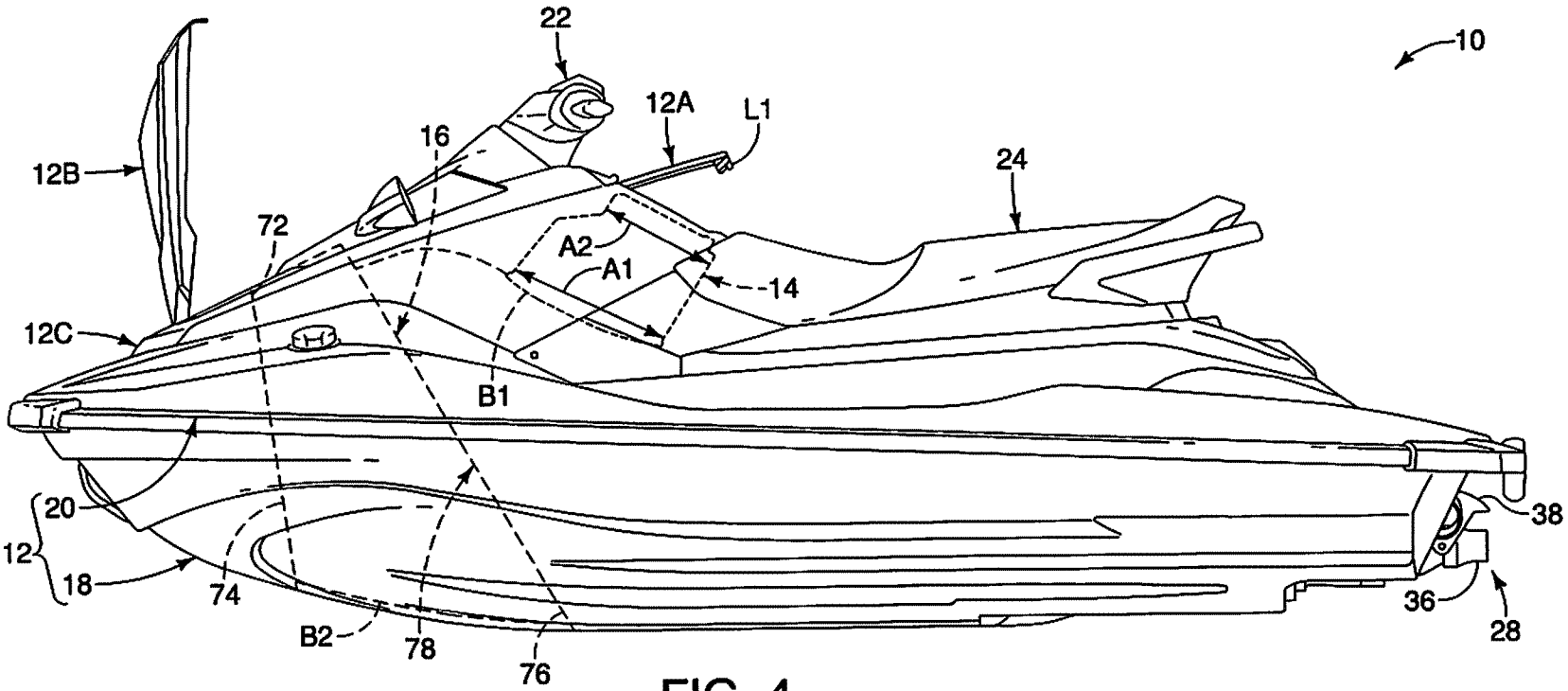
FIG. 4 is a left side (port) elevational view of the personal watercraft illustrated in FIGS. 1 to 3 in which the lids of the first and second storage containers are open.
Figure 5:
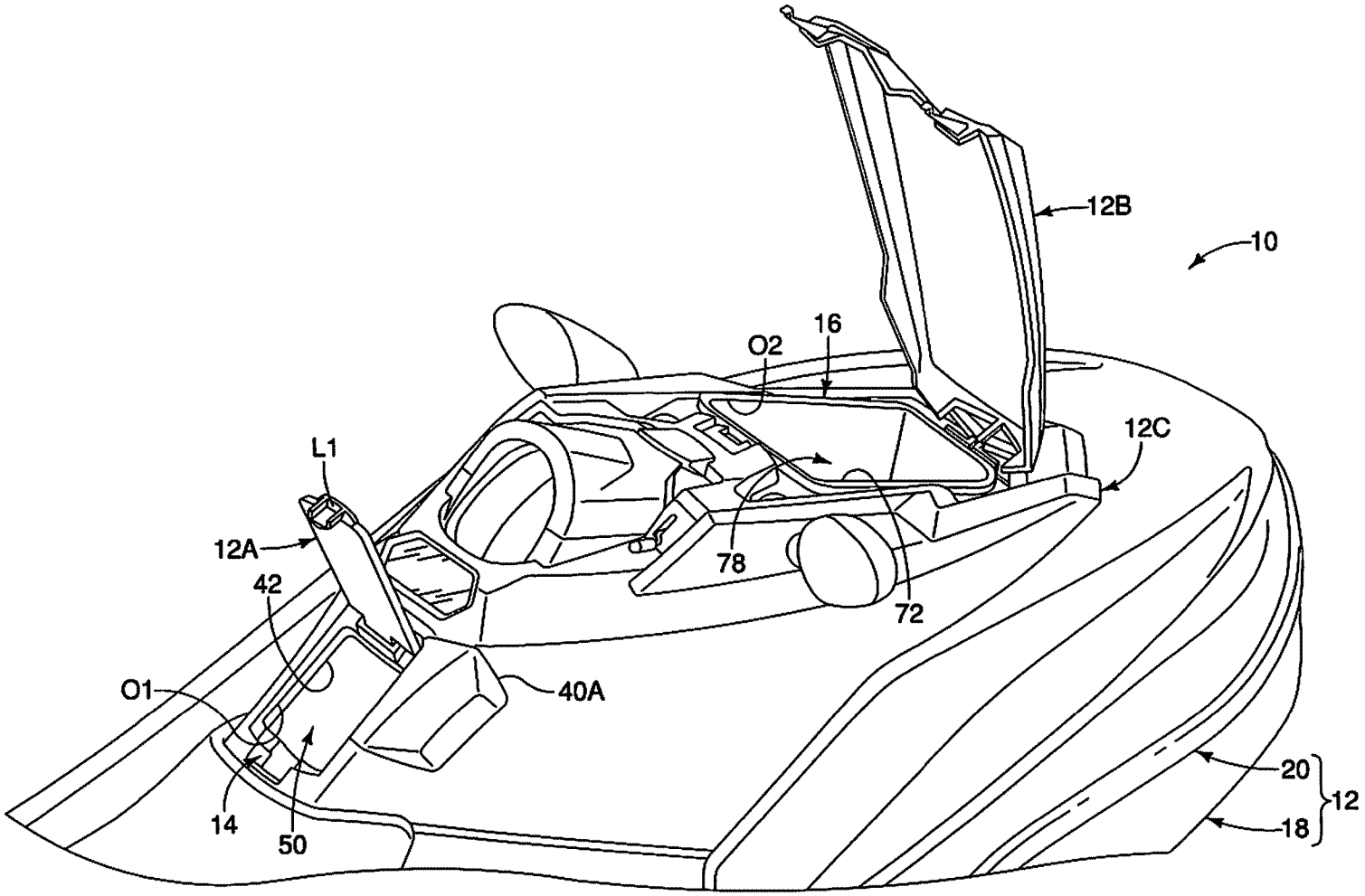
FIG. 5 is a rear perspective view of the personal watercraft illustrated in FIGS. 1 to 4 with the steering assembly removed to show the lids of the first and second storage containers are open.

As seen in FIGS. 1, 4 and 5, the watercraft 10 basically comprises a watercraft body 12 and a first storage container 14. In the illustrated embodiment, as also seen in FIGS. 1, 4 and 5, the watercraft 10 further comprises a second storage container 16. The first and second storage containers 14 and 16 are provided on the watercraft body 12 for the rider to store various articles or items. While the watercraft body 12 illustrated with two storage containers, the watercraft body 12 can be provided with only one of the first and second storage containers 14 and 16 or can have additional storage containers as needed and/or desired.

Figure 9:
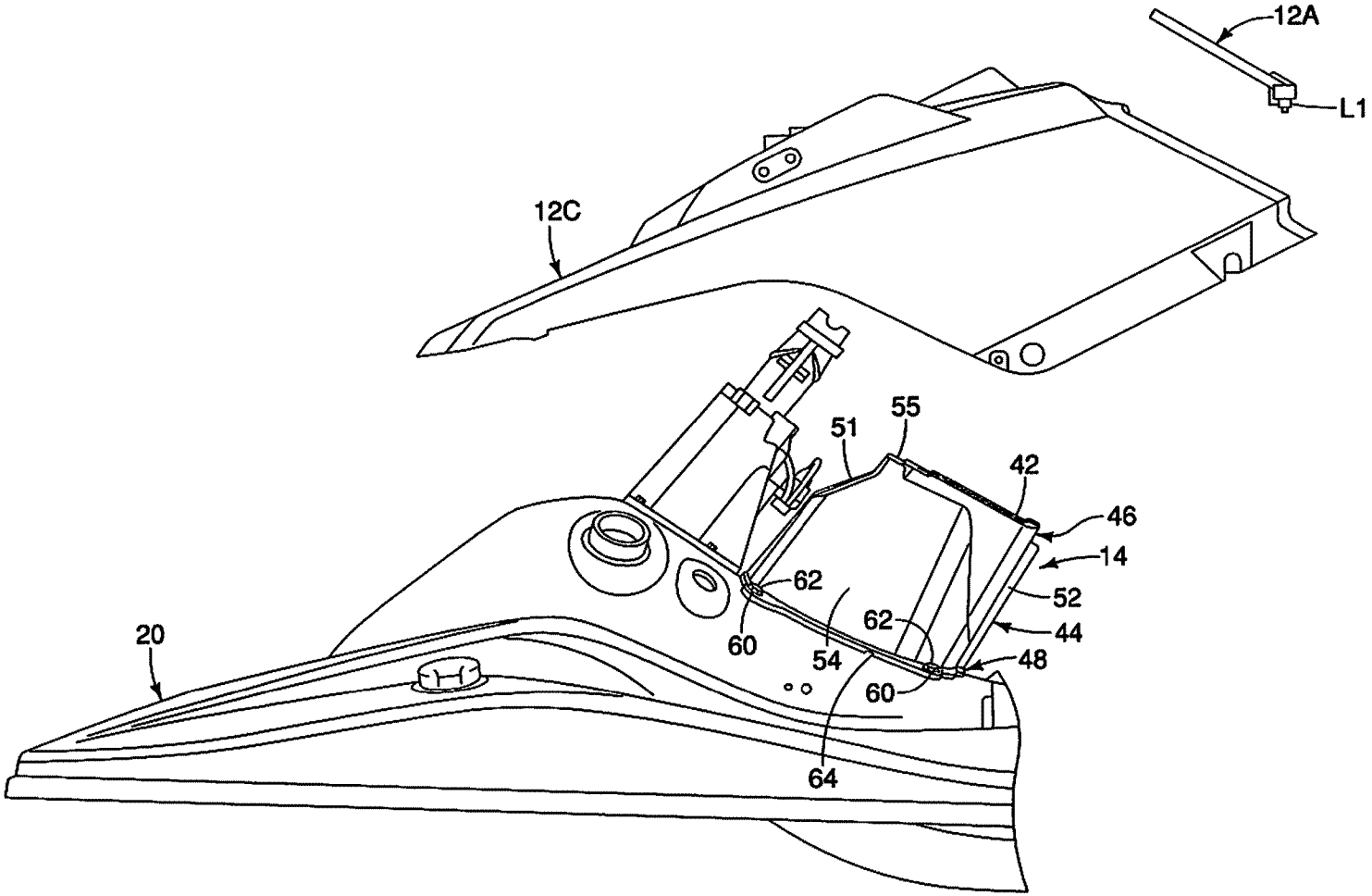
FIG. 9 is an exploded, left side (port) elevational view of selected portions of the watercraft body illustrated in FIGS. 1 to 7 to reveal the first storage container.

Basically, the watercraft body 12 includes a hull 18 and a deck 20. The watercraft body 12 also includes other body panels. For example, as seen in FIGS. 1 to 6, the watercraft body 12 of the watercraft 10 further comprises a first lid 12A for closing the first storage container 14 and a second lid 12B for closing the second storage container 16. The watercraft body 12 of the watercraft 10 further comprises a body panel 12C (see, FIGS. 9 and 10) that movably supports the first and second lids 12A and 12B between open and closed positions. Alternatively, the first and second lids 12A and 12B can be attached directly to the first and second storage containers 14 and 16, respectively. In the illustrated embodiment, the first and second lids 12A and 12B are movably supported to the body panel 12C of the watercraft body 12 between open and closed positions. In any case, the first lid 12A is movably coupled to one of the first storage container 14 and the watercraft body 12, while the second lid 12B is movably coupled to one of the second storage container 16 and the watercraft body 12.

Figure 10:
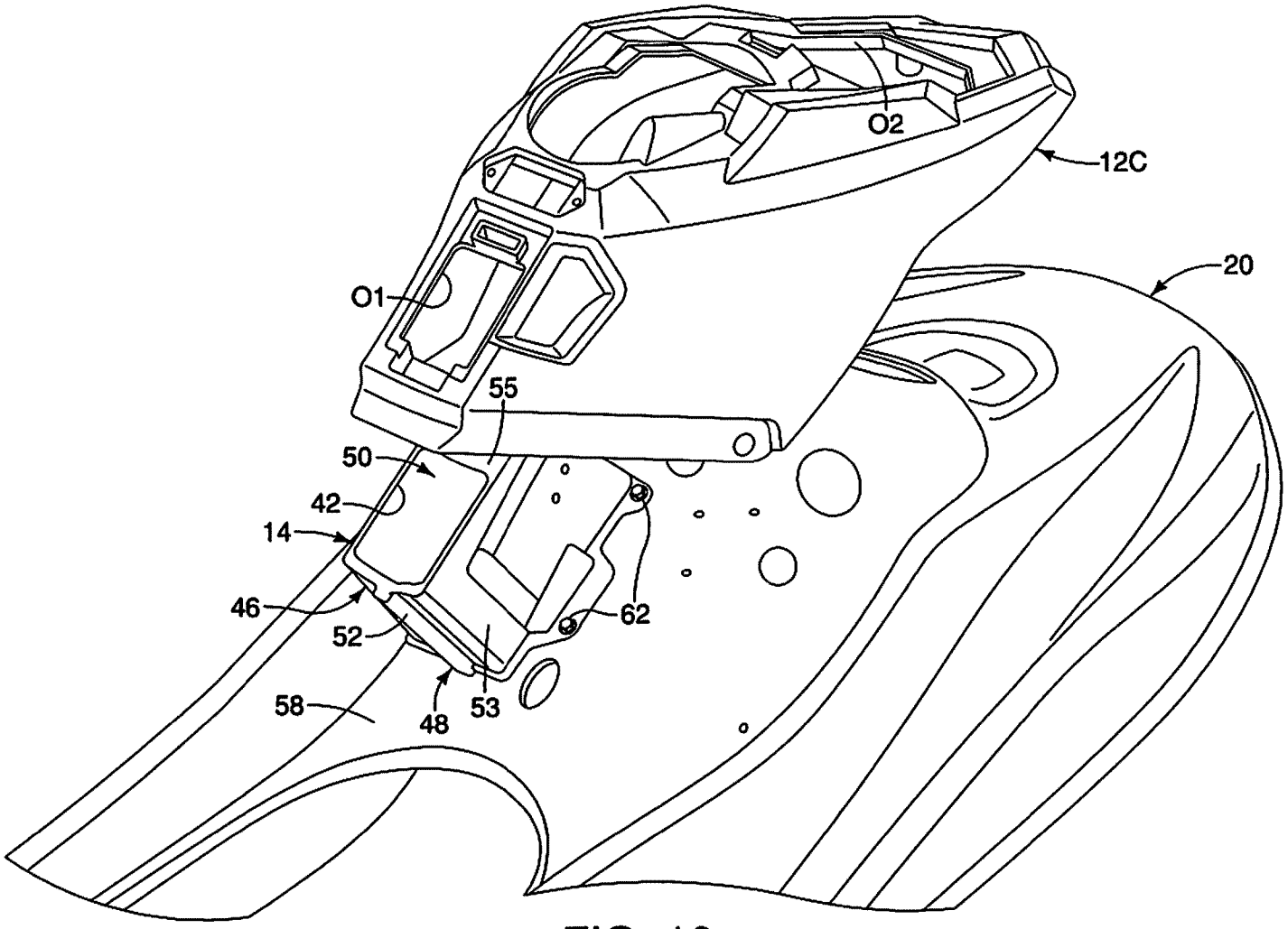
FIG. 10 is an exploded perspective view of selected portions of the watercraft body illustrated in FIGS. 1 to 7 to reveal the first storage container.

In the illustrated embodiment, as best seen in FIG. 10, the body panel 12C has a first lid opening O1 and a second lid opening O2. The first lid 12A is pivotally coupled to the body panel 12C to open and close the first lid opening O1, while the second lid 12B is pivotally coupled to the body panel 12C to open and close the second lid opening O2. Each of the first and second lids 12A and 12B preferably has a latch for selectively engaging a portion of the body panel 12C to retain the first and second lids 12A and 12B, respectively, in the closed position. For example, the first lid 12A has a first latch L1 that engages a portion of the body panel 12C to retain the first lid 12A in the closed position.

The deck 20 is provided on the hull 18 in a conventional manner. Preferably, the hull 18 and the deck 20 are integrated to form a unit. The body panel 12C is preferably detachably mounted to the deck 20. The first lid 12A, the second lid 12B, the body panel 12C, the first storage container 14, the second storage container 16, the hull 18, the deck 20 and the other parts of the watercraft body 12 are made of suitable materials that are typically used in watercrafts for a marine environment. Thus, the materials of the first lid 12A, the second lid 12B, the body panel 12C, the first storage container 14, the second storage container 16, the hull 18, the deck 20 and the other parts of the watercraft body 12 will not be discussed herein.

Figure 6:
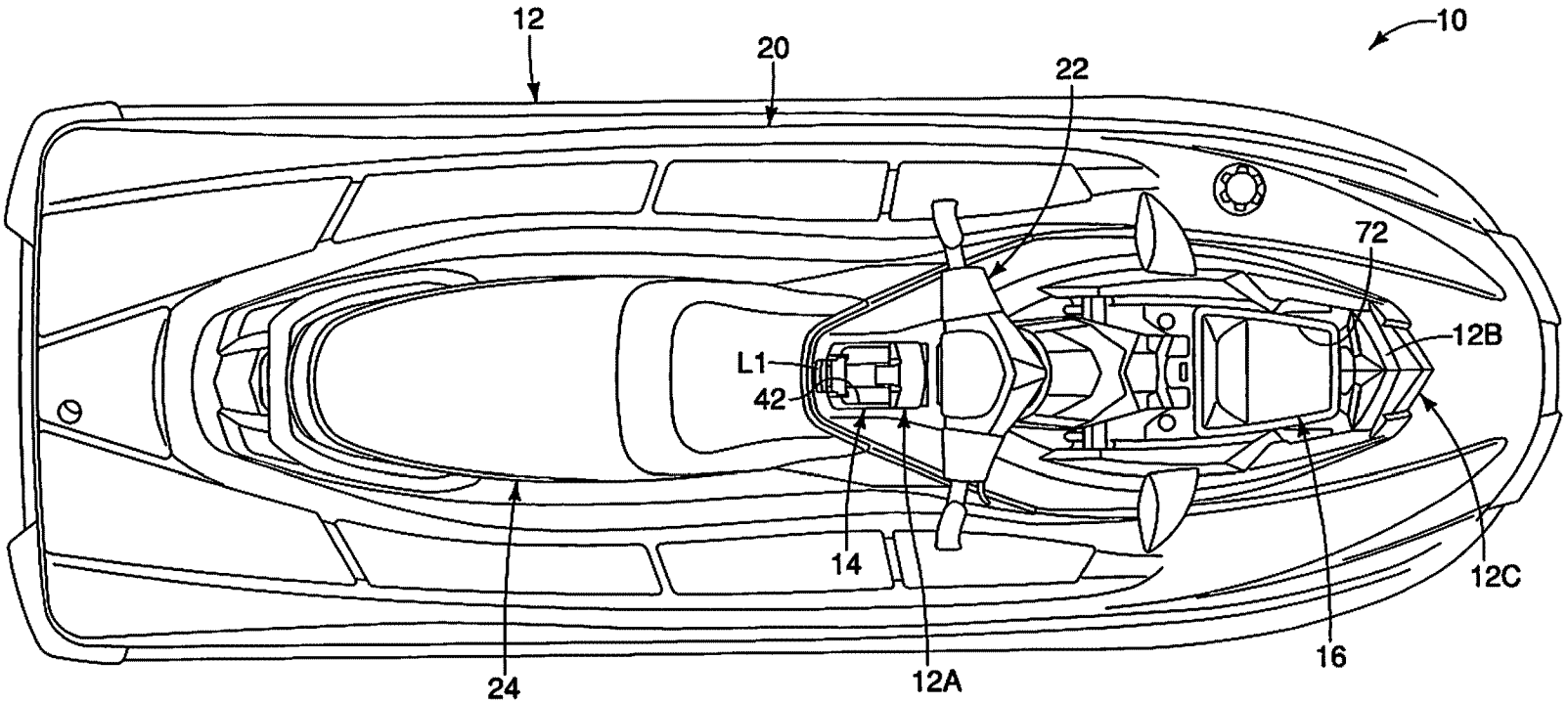
FIG. 6 is a top plan view of the personal watercraft illustrated in FIGS. 1 to 5 in which the lids of the first and second storage containers are open.
Figure 7:
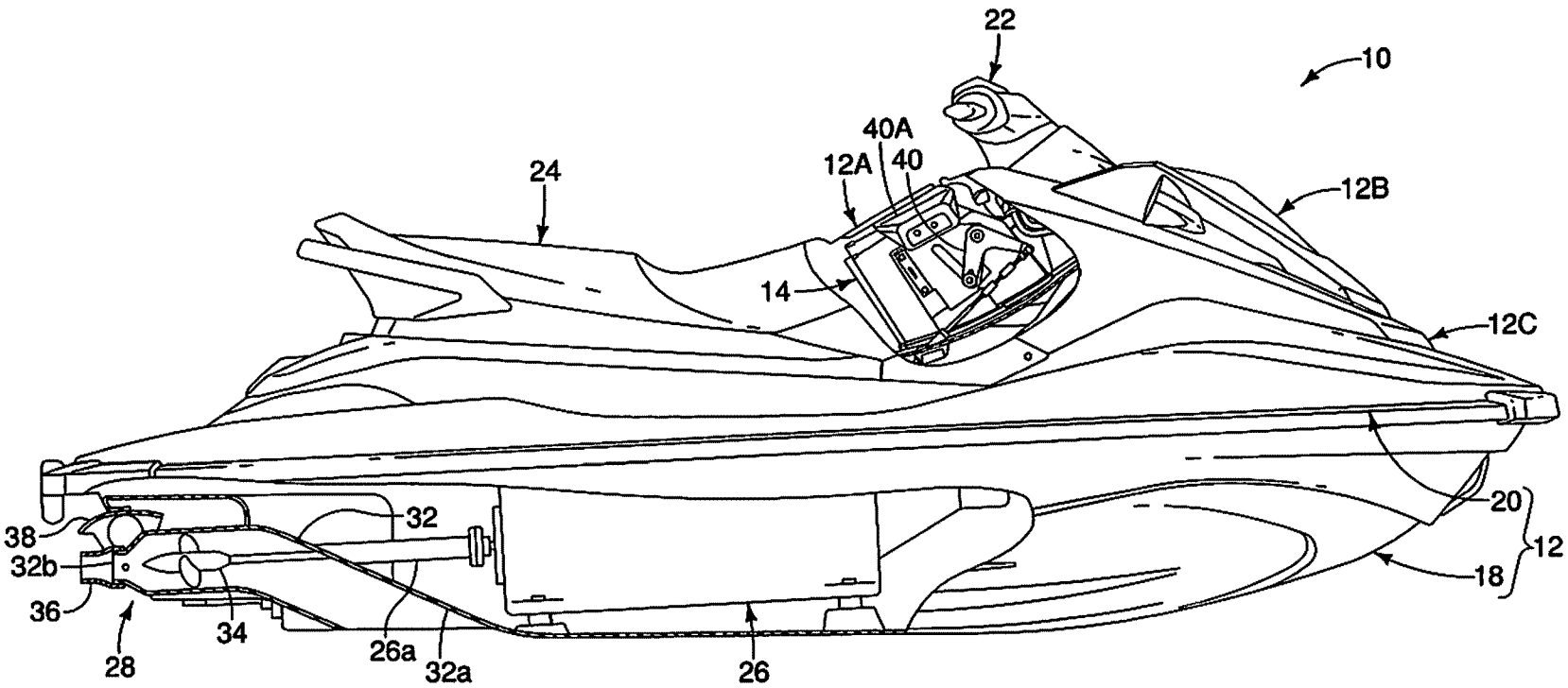
FIG. 7 is a side (starboard) elevational view, similar to FIG. 1, of the personal watercraft illustrated in FIGS. 1 to 6 but with portions of the watercraft body broken away to show the first storage container mounted to the deck and the propulsion unit mounted to the hull.

In the illustrated embodiment, as seen in FIGS. 6 and 7, the watercraft 10 is a personal watercraft that further comprises a handlebar 22 and a straddle seat 24. The handlebar 22 is turnably supported on the deck 20 in a conventional manner. Here, the handlebar 22 is a bar-type steering handle that is turnably disposed relative to the watercraft body 12 for steering the watercraft. The straddle seat 24 is detachably attached to the deck 20 by fasteners (not shown) in a conventional manner. The straddle seat 24 is disposed on the deck 20 at a rearward location of the handlebar 22.

As seen in FIG. 7, the watercraft 10 further comprises an engine 26 and a jet propulsion unit 28. The engine 26 and the jet propulsion unit 28 are disposed on the hull 18 inside of the watercraft body 12. The straddle seat 24 is disposed above the engine 26. Preferably, the straddle seat 24 is detachably mounted to the deck 20 for accessing an interior area of the watercraft body 12 where the engine 26 and the jet propulsion unit 28 are disposed. A fuel tank (not shown) is disposed on a front portion of the hull 18 inside of the watercraft body 12. Since the fuel tank, the handlebar 22, the straddle seat 24 and the engine 26 are conventional parts of a personal watercraft, these conventional parts will not be discussed or illustrated in detail herein.

As seen in FIG. 7, the jet propulsion unit 28 is also a conventional device in the watercraft field, and thus, the jet propulsion unit 28 will be only briefly discussed and illustrated herein. Basically, the jet propulsion unit 28 includes a housing 32, an impeller 34 and a steering nozzle 36. The housing 32 is mounted on the hull 18. The housing 32 has a water inlet 32*a* and a water outlet 32*b*. The impeller 34 is rotatably mounted inside the housing 32 between the water inlet 32*a* and the water outlet 32*b*. The steering nozzle 36 is pivotally mounted relative to the housing 32 at a location rearward of the water outlet 32*b*. The steering nozzle 36 is operatively connected to the handlebar 22 in a conventional manner such as using cables and/or linkages. The impeller 34 of the jet propulsion unit 28 is operatively connected to a drive shaft 26*a* of the engine 26. In this way, rotation of the drive shaft 26*a* by the engine 26 rotates the impeller 34 inside the housing 32. This rotation of the impeller 34 sucks water into the housing 32 via the water inlet 32*a* and then forces the water at a higher velocity from the housing 32 through the steering nozzle 36 via the water outlet 32*b*.

Figure 8:
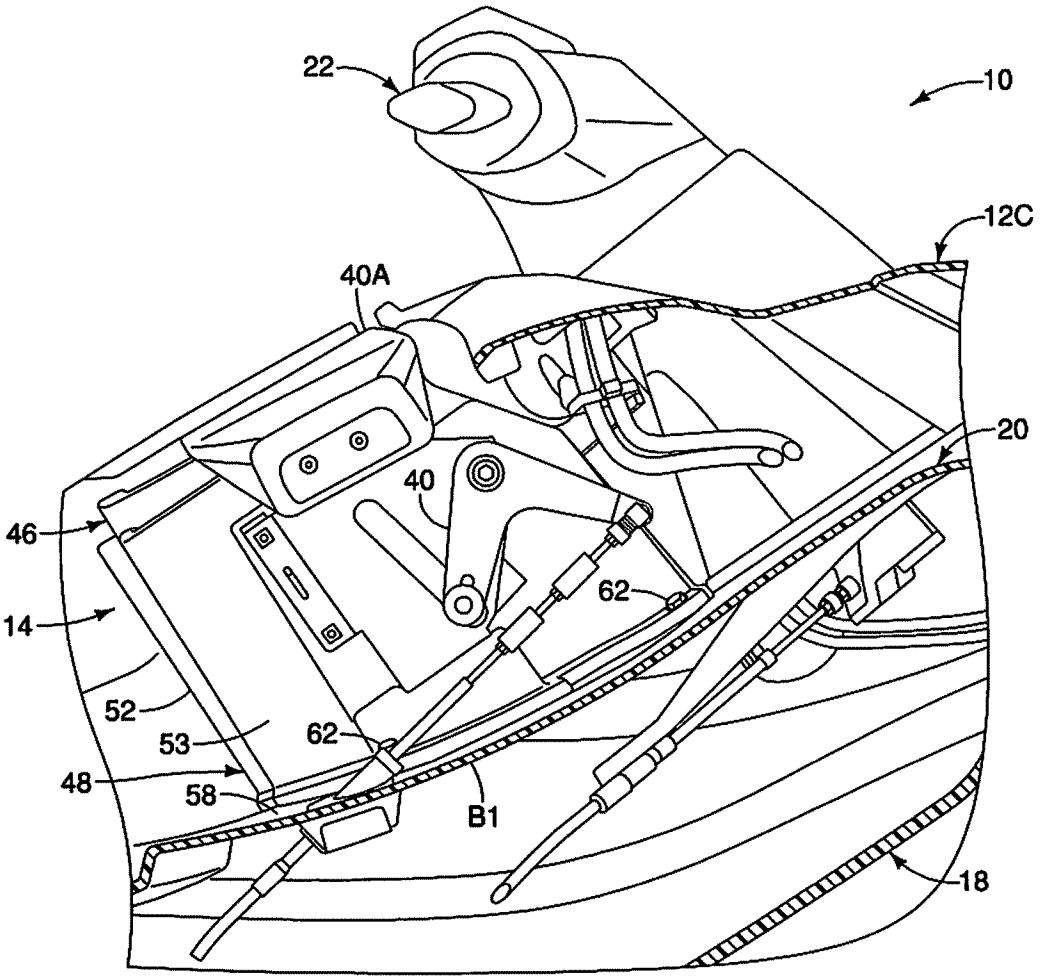
FIG. 8 is a partial right side (starboard) elevational view of the personal watercraft illustrated in FIGS. 1 to 7 with portions of the watercraft body broken away to show the first storage container mounted to the deck.
Figure 11:
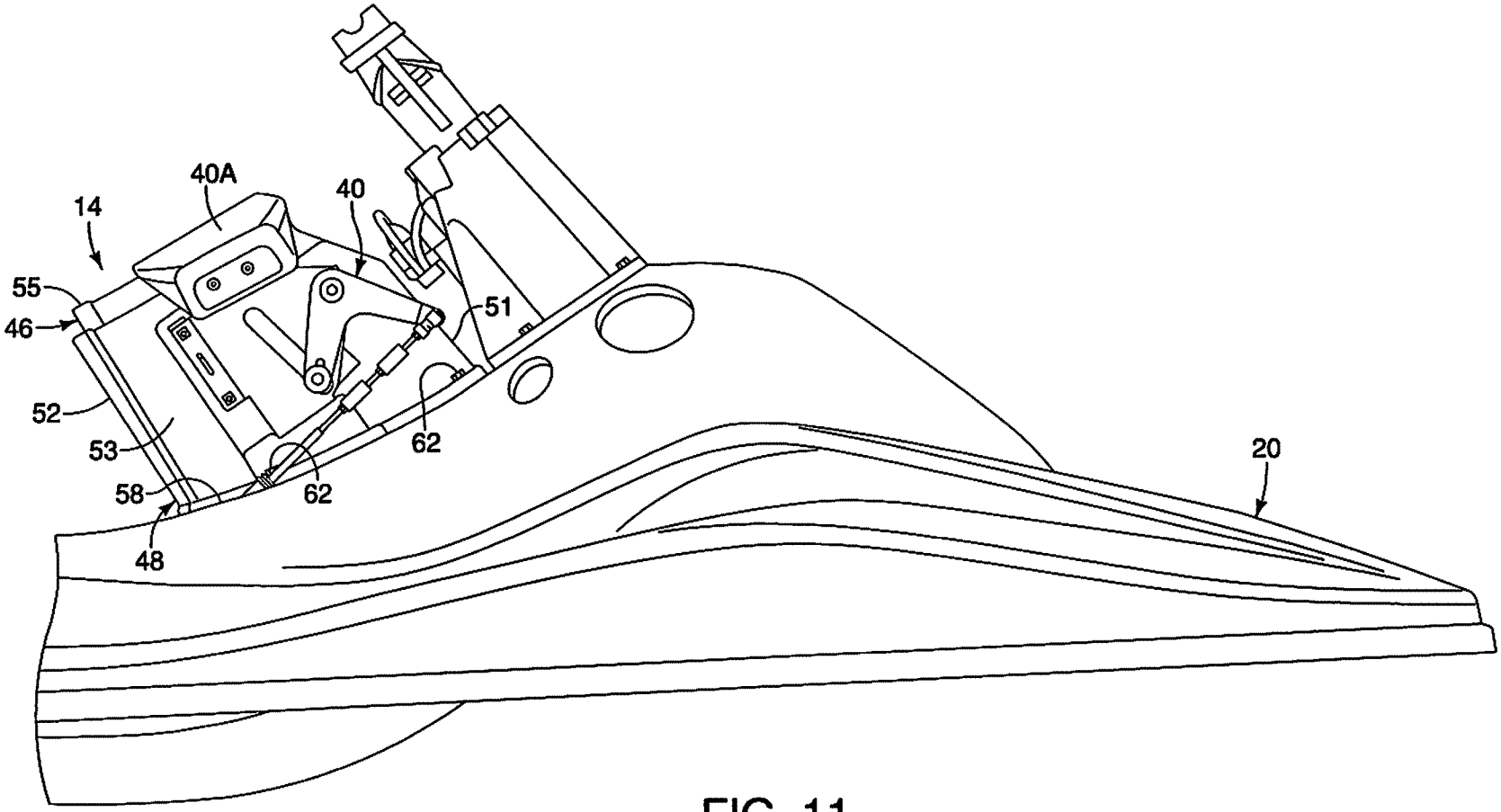
FIG. 11 is a partial right side (starboard) elevational view of a portion of the deck and the first storage container of the personal watercraft illustrated in FIGS. 1 to 7.

In the illustrated embodiment, the jet propulsion unit 28 is provided with a reverse gate 38. The reverse gate 38 is pivotally mounted relative to the steering nozzle 36 between a forward position in which the reverse gate 38 is offset from the outlet of the steering nozzle 36 and a reverse position in which the reverse gate 38 is aligned with the outlet of the steering nozzle 36. To control the reverse gate 38, as seen in FIGS. 7, 8 and 11, the watercraft 10 further comprises a control member 40 that is pivotally mounted to the first storage container 14. The control member 40 is operatively coupled to the reverse gate 38 of the jet propulsion unit 28 in a conventional manner such as using cables and/or linkages. The control member 40 has a rider operating handle 40A for rider to operate the reverse gate 38 via the control member 40. Alternatively, a control lever can be provided on the handlebar 22 instead of providing the control member 40 on the first storage container 14. The control member 40 is pivotally mounted to the first storage container 14.

Now, the first storage container 14 will be discussed in more detail with reference to FIGS. 14 to 17. The first storage container 14 is attached to the deck 20. The first storage container 14 is located between the handlebar 22 and the straddle seat 24. In this way, the rider can easily access articles that are disposed in the first storage container 14, while the rider is sitting on the straddle seat 24. Basically, the first storage container 14 includes an access opening 42 and an annular sidewall 44. The access opening 42 opens upward relative to the deck 20. The first lid 12A is pivotally coupled to the body panel 12C between an opened position that exposes the access opening 42 and a closed position that covers the access opening 42. The first lid 12A is configured to open such that the access opening 42 opens rearward. In other words, the first lid 12A pivots upwardly and then towards the front end of the watercraft body 12. In this way, the first lid 12A does not interfere with the rider accessing articles that are disposed in the first storage container 14, while the rider is sitting on the straddle seat 24.

The annular sidewall 44 has an upper end 46, a lower end 48 and an interior storage space 50 between the upper end 46 and the lower end 48. The annular sidewall 44 further includes a front wall portion 51 that faces the handlebar 22 and a rear wall portion 52 that faces the straddle seat 24. The annular sidewall 44 further includes a first wall portion 53 that faces in a starboard direction and a second wall portion 54 that faces in a port direction. The first and second wall portions 53 and 54 connect the front and rear wall portions 51 and 52 to define the interior storage space 50. Here, the control member 40 is pivotally mounted to the first wall portion 53 of the annular sidewall 44. Thus, the first wall portion 53 is provided with one or more mounting holes or openings for mounting the control member 40 to the first wall portion 53. Of course, it will be apparent from this disclosure that the control member 40 can be pivotally mounted to the second wall portion 54 of the annular sidewall 44.

The first storage container 14 further includes a top wall 55 that is connected to the annular sidewall 44 at the upper end 46. In the illustrated embodiment, the top wall 55 defines the access opening 42. However, it will be apparent from this disclosure that the top wall 55 can be omitted such that the upper end 46 of the annular sidewall 44 defines the access opening 42. Here, the access opening 42 has a rectangular shape. However, it will be apparent from this disclosure that the access opening 42 can have other shapes.

Preferably, the front wall portion 51 is inclined relative to the rear wall portion 52. As a result, the lower end 48 of the annular sidewall 44 at the front wall portion 51 is disposed farther from the lower end 48 of the annular sidewall 44 at the rear wall portion 52 than is the upper end 46 of the annular sidewall 44 at the front wall portion 51 with respect to the upper end 46 of the annular sidewall 44 at the rear wall portion 52. Moreover, the lower end 48 of the annular sidewall 44 at the front wall portion 51 is disposed forward relative to the upper end 46 of the annular sidewall 44 at the front wall portion 51. In this way, the interior storage space 50 can extend beneath the handlebar 22.

Figure 12:
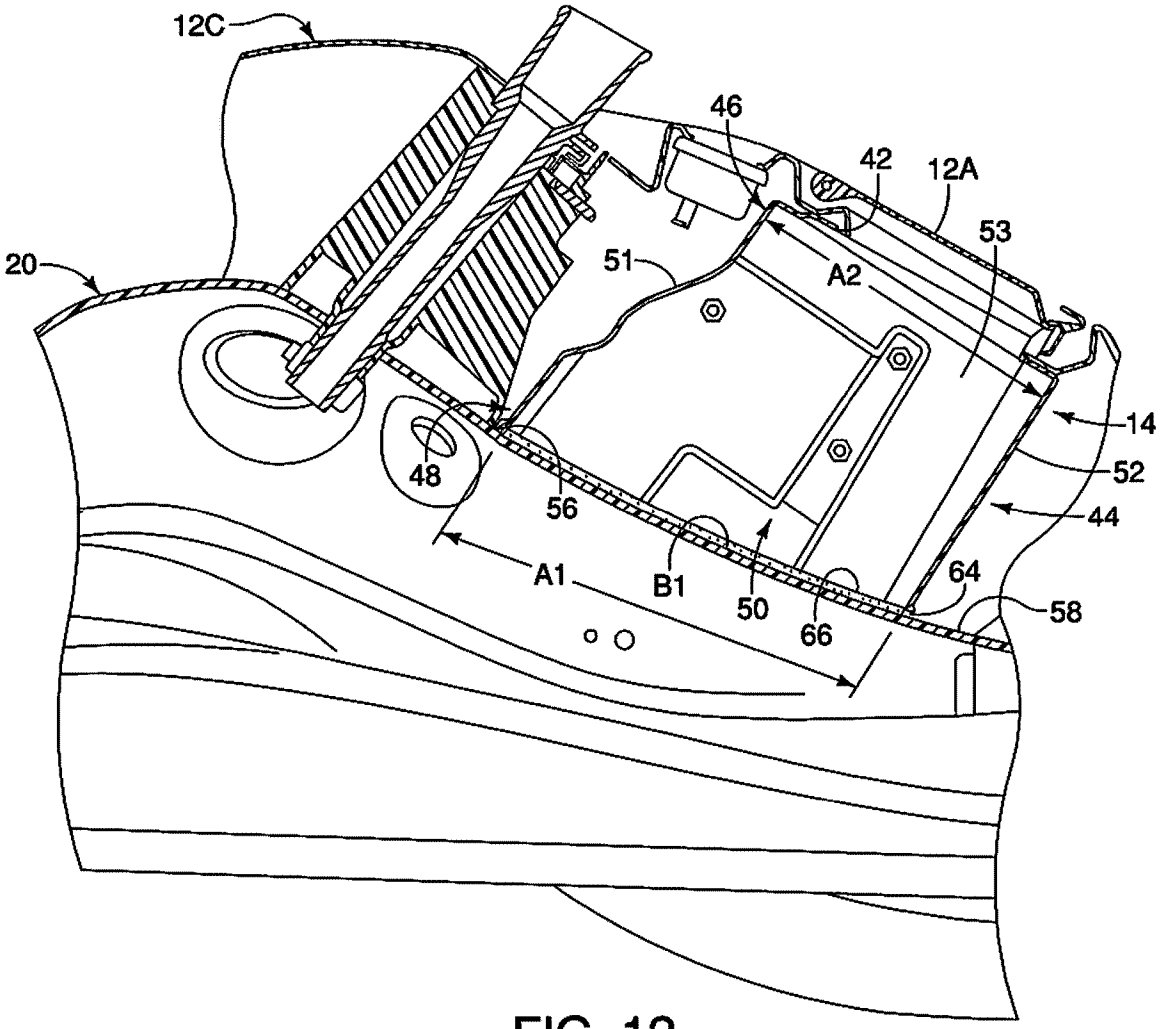
FIG. 12 is a partial cross sectional view of the deck and the first storage container of the personal watercraft illustrated in FIGS. 1 to 7.
Figure 13:
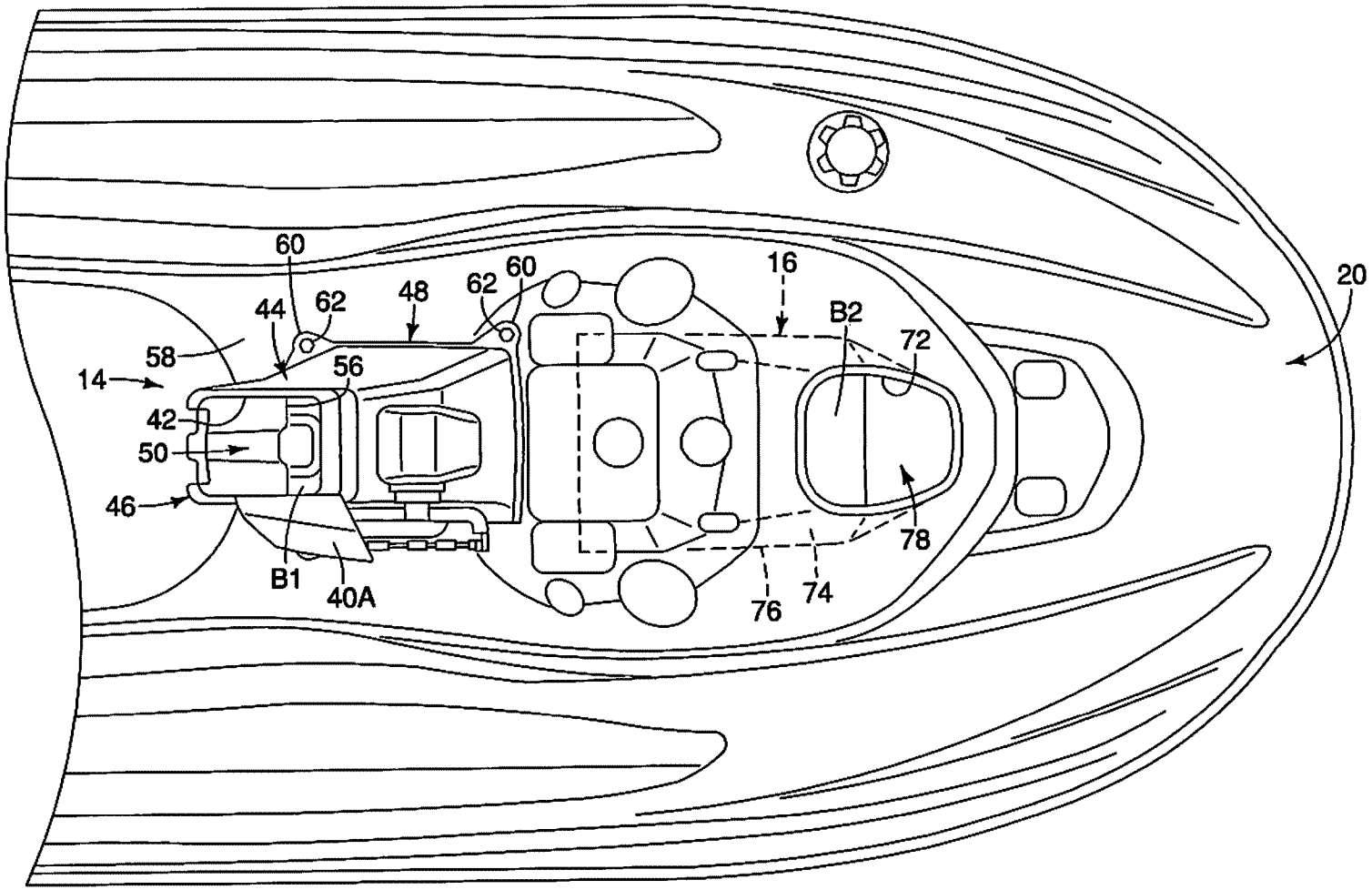
FIG. 13 is a partial top plan view of a portion of the deck and the first storage container of the personal watercraft illustrated in FIGS. 1 to 7.
Figure 14:
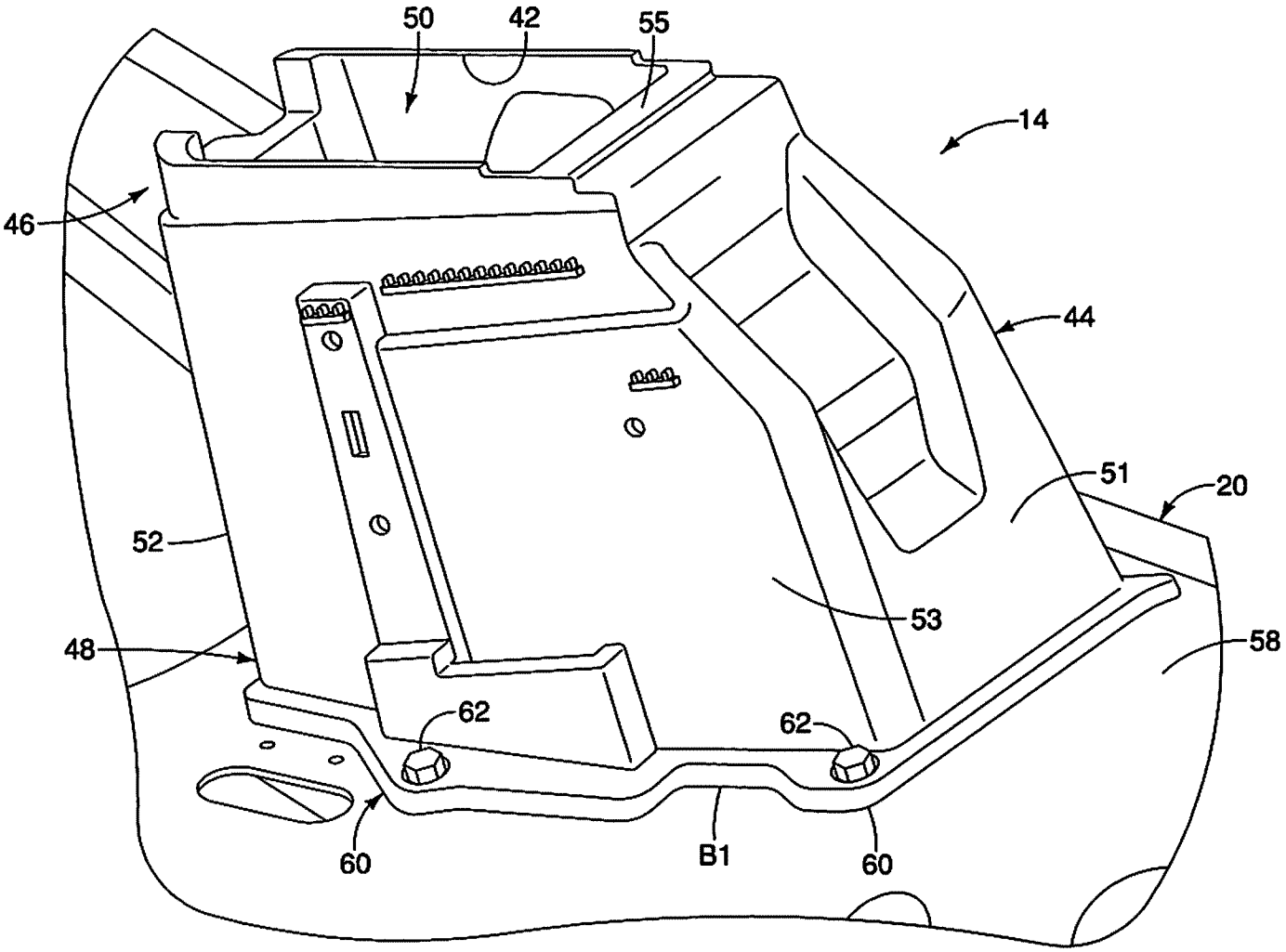
FIG. 14 is a front perspective view of a portion of the deck and the first storage container of the personal watercraft illustrated in FIGS. 1 to 7.
Figure 15:
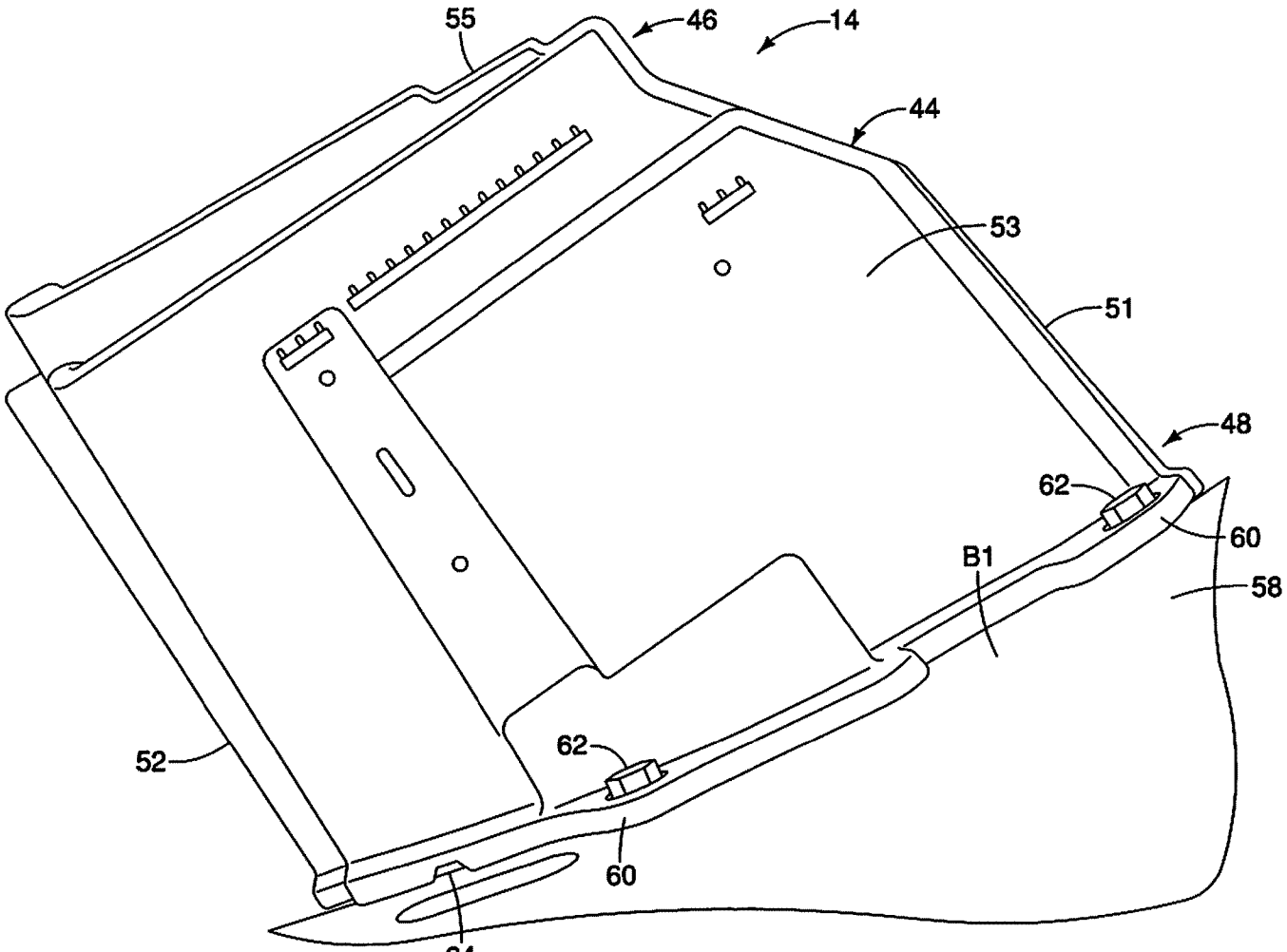
FIG. 15 is a partial right side (starboard) elevational view of a portion of the deck and the first storage container of the personal watercraft illustrated in FIGS. 1 to 7.
Figure 16:
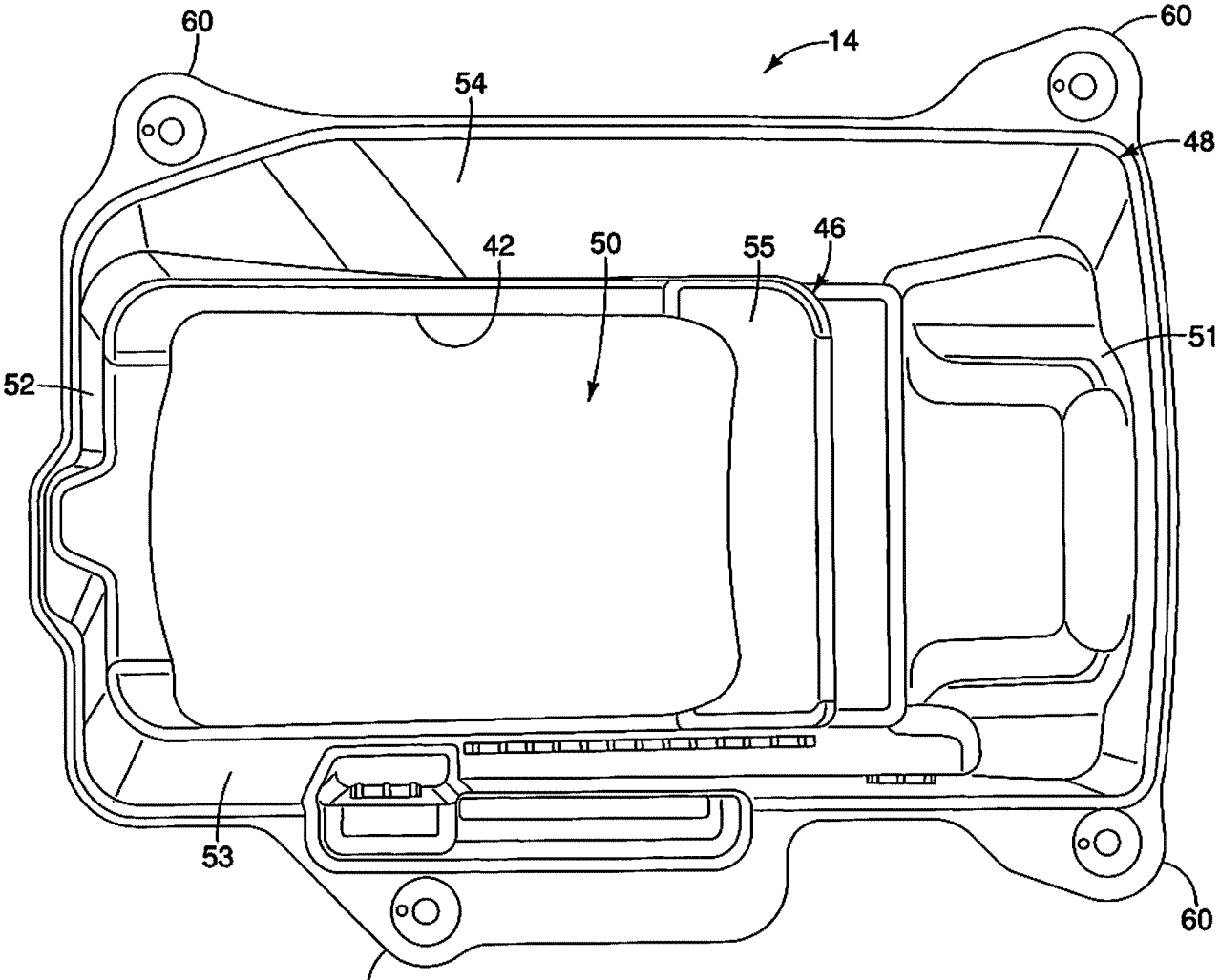
FIG. 16 is a top view of the first storage container of the personal watercraft illustrated in FIGS. 1 to 7.
Figure 17:
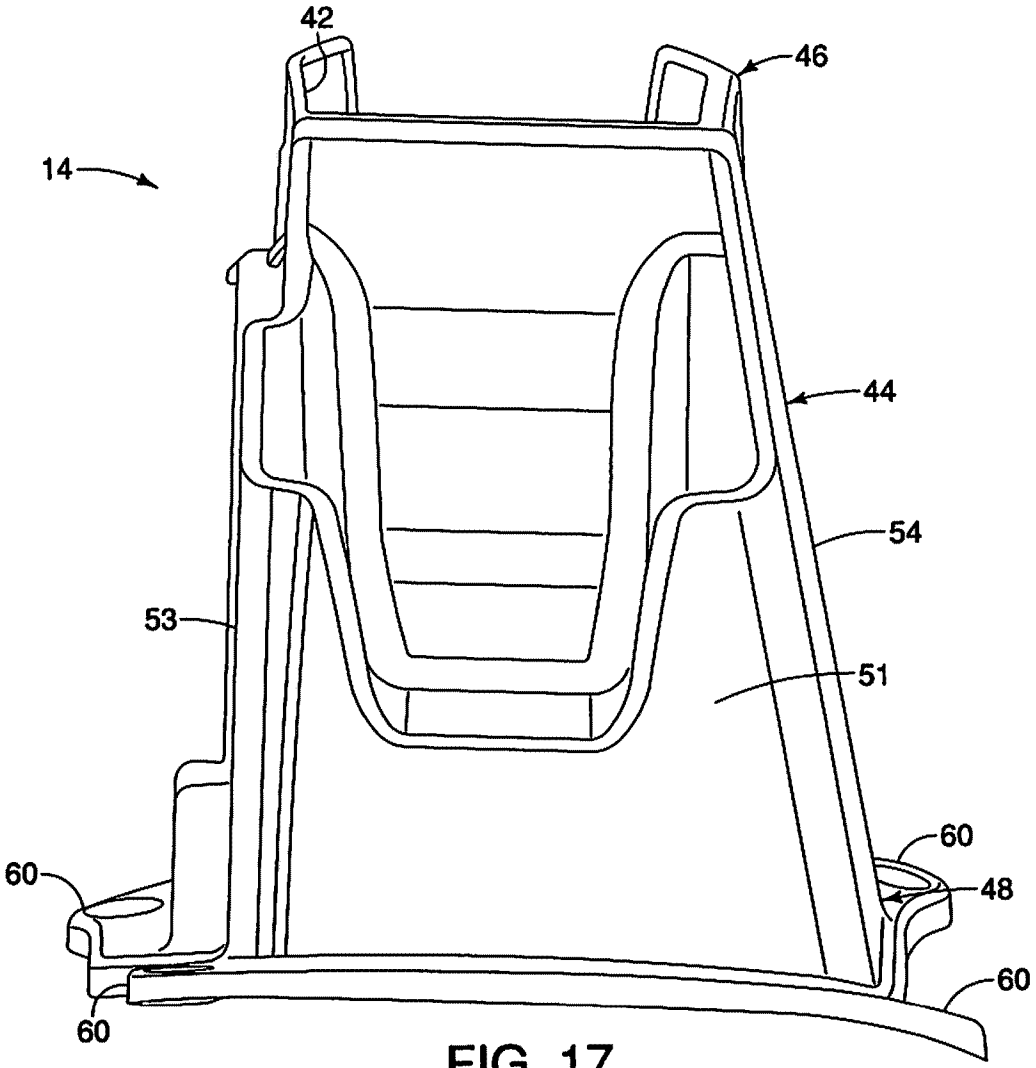
FIG. 17 is a front end view of the first storage container of the personal watercraft illustrated in FIGS. 1 to 7.

Preferably, as seen in FIG. 12, the annular sidewall 44 tapers between the upper end 46 and the lower end 48 with respect to an axial direction extending axially through the interior storage space 50 between the upper end 46 and the lower end 48. As a result, the lower end 48 of the annular sidewall 44 defines a bottom opening 56 with a cross sectional area A1 that is larger than a cross sectional area A2 of the upper end 46 of the annular sidewall 44.

As seen in FIG. 12, the first storage container 14 is attached to an upper deck surface 58 of the deck 20 to close off the bottom opening 56 of the annular sidewall 44 such that the upper deck surface 58 forms a bottom portion or wall B1 of the first storage container 14. In particular, as seen in FIGS. 14 to 17, the annular sidewall 44 further includes at least one mounting flange 60 extending outwardly with respect to the interior storage space 50. The at least one mounting flange 60 is secured to the deck 20. The at least one mounting flange 60 preferably includes four of mounting flanges 60 that are each fastened to the deck 20. The mounting flanges 60 are secured to the deck 20 by fasteners 62.

In the illustrated embodiment, the annular sidewall 44 and the upper deck surface 58 of the deck 20 define at least one drainage opening 64 therebetween. Here, the annular sidewall 44 is configured to define a plurality of the drainage openings 64. In particular, the lower end 48 of the annular sidewall 44 has a plurality of notches that define the drainage openings 64. Alternatively, the drainage openings 64 can be omitted if a watertight seal is provided between the first storage container 14 and the first lid 12A and a sealing member is provided between the annular sidewall 44 and the upper deck surface 58 of the deck 20.

The first storage container 14 is a single unitary injection molded part that has a draw direction extending axially through the interior storage space 50 between the upper end 46 and the lower end 48. The first storage container 14 is free of an undercut surface facing inside the interior storage space 50 after injection molding. In other words, the annular sidewall 44, the top wall 55 and the mounting flanges 60 are integrally formed as a one-piece member by straight draw-type injection molding in which two dies or molds are separated in a single draw direction without using slides or the like to create undercuts. The one or more mounting holes or openings for mounting the control member 40 are formed after the first storage container 14 is molded. The surfaces forming the annular sidewall 44 are typically angled slightly with a prescribed draft angle to ease release of the first storage container 14 from the dies or molds.

As seen in FIG. 12, the watercraft 10 further comprises a pad 66 that is attached to the bottom portion B1 that is formed by the deck 20. The pad 66 is made of a suitable material such as a foam rubber material. The pad 66 provides a soft padded surface to the hard material of the deck 20.

Now, the second storage container 16 will now be briefly discussed with reference back to FIGS. 1 to 6 and 13. The second storage container 16 is attached to the hull 18. The second storage container 16 is located in front of the handlebar 22. The second storage container 16 has the same overall construction as the first storage container 14, except that the second storage container 16 has been configured and fixed to extend between the hull 18 and the body panel 12C. Thus, in the case of the second storage container 16, the hull 18 forms a bottom wall or portion B2 of the second storage container 16.

Similar to the first storage container 14, the second storage container 16 includes an access opening 72 and an annular sidewall 74. The annular sidewall 74 defines a bottom opening 76 with a cross sectional area that is larger than a cross sectional area of the upper end of the annular sidewall 74. The annular sidewall 74 defines an interior storage space 78 that extends from the access opening 72 to the bottom opening 76. The access opening 72 opens upward relative to the hull 18. The second lid 12B is pivotally coupled to the body panel 12C between an opened position that exposes the access opening 72 and a closed position that covers the access opening 72. Here, the access opening 72 has a rectangular shape. However, it will be apparent from this disclosure that the access opening 72 can have other shapes. Similar to the first storage container 14, the second storage container 16 includes one or more mounting flanges (not shown) for securing the second storage container 16 to the hull 18. The second storage container 16 is attached to an interior surface of the hull 18 to close off the bottom opening 76 of the annular sidewall 74 such that the interior surface of the hull 18 forms the bottom portion or wall B2 of the second storage container 16.

The second storage container 16 is a single unitary injection molded part that is free of an undercut surface facing inside the interior storage space 78. The annular sidewall 74 of the second storage container 16 tapers from the access opening 72 to the bottom opening 76.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Thus, as used herein, the singular forms "a," "an" and "the" are intended to include the plural forms as well, unless the context clearly indicates otherwise. Also, the terms "part," "section," "portion," "member" or "element" when used in the singular can have the dual meaning of a single part or a plurality of parts. Unless otherwise defined, all terms (including technical and scientific terms) used herein have the same meaning as commonly understood by one of ordinary skill in the art to which illustrative embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items. Additionally, similar words used to describe the relationship between elements or layers should be interpreted in a like fashion (e.g., "between" versus "directly between", "above" versus "directly above", "below" versus "directly below", "adjacent" versus "directly adjacent," "on" versus "directly on"). Thus, components that are shown directly connected or contacting each other can have intermediate structures disposed between them unless specified otherwise.

It will be understood that, although the terms "first", "second", etc. may be used herein to describe various elements, components, regions, layers, positions and/or sections, these elements, components, regions, layers, positions and/or sections should not be limited by these terms. These terms are only used to distinguish one element, component, region, layer, position or section from another element, component, region, layer, position or section. Thus, a first element, component, region, layer, position or section discussed above could be termed a second element, component, region, layer, position or section without departing from the teachings of illustrative embodiments.

Spatially relative terms, such as "forward", "rearward", "above", "below", "beneath", "downward", "vertical", "horizontal", and "transverse" as well as any other similar spatial terms may be used herein for the ease of description to describe one element or feature's relationship to another element(s) or feature(s) of the above embodiments. These terms, as utilized to describe the present invention should be interpreted relative to a watercraft floating in calm water.

The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A personal watercraft comprising:

a watercraft body including a hull and a deck provided on the hull;

a handlebar rotatably disposed relative to the watercraft body;

a straddle seat disposed on the deck at a rearward location of the handlebar; and a storage container attached to the watercraft body, the storage container including an access opening that opens upward relative to the deck, and a sidewall surrounding an interior storage space, the sidewall having an upper end and a lower end, with the interior storage space between the upper end and the lower end, the access opening being disposed in the upper end which is spaced vertically above the lower end with the watercraft in a horizontal position, the lower end of the sidewall defining a bottom opening with a cross sectional area that is larger than a cross sectional area of the upper end of the sidewall, the bottom opening and the access opening being disposed at opposite end walls of the storage container.

2. A personal watercraft comprising:

a watercraft body including a hull and a deck provided on the hull;

a handlebar rotatably disposed relative to the watercraft body;

a straddle seat disposed on the deck at a rearward location of the handlebar; and a storage container attached to the watercraft body, the storage container including an access opening that opens upward relative to the deck, and a sidewall surrounding an inner storage space, the sidewall having an upper end and a lower end, with the interior storage space between the upper end and the lower end, the lower end of the sidewall defining a bottom opening with a cross sectional area that is larger than a cross sectional area of the upper end of the sidewall, the storage container being a single unitary injection molded part that has a draw direction extending axially through the interior storage space between the upper end and the lower end, the storage container being free of an undercut surface facing inside the interior storage space.

3. The personal watercraft according to claim 1, wherein the sidewall tapers between the upper end and the lower end with respect to an axial direction extending axially through the interior storage space between the upper end and the lower end.

4. A personal watercraft comprising:

a watercraft body including a hull and a deck provided on the hull;

a handlebar rotatable disposed relative to the watercraft body;

a straddle seat disposed on the deck at a rearward location of the handlebar; and a storage container attached to the watercraft body, the storage container including an access opening that opens upward relative to the deck, and a sidewall surrounding an interior storage space, the sidewall having an upper end and a lower end, with the interior storage space between the upper end and the lower end, the lower end of the sidewall defining a bottom opening with a cross sectional area that is larger than a cross sectional area of the upper end of the sidewall, the storage container being attached to an upper deck surface of the deck to close off the bottom opening of the sidewall such that the upper deck surface forms a bottom portion of the storage container.

5. The personal watercraft according to claim 4, further comprising a pad attached to the bottom portion of the storage container that is formed by the deck.

6. The personal watercraft according to claim 4, wherein the sidewall and the upper deck surface of the deck define at least one drainage opening therebetween.

7. The personal watercraft according to claim 1, wherein the storage container is located between the handlebar and the straddle seat.

8. The personal watercraft according to claim 7, wherein the sidewall includes a front wall portion that faces the handlebar and a rear wall portion that faces the straddle seat, the front wall portion being inclined relative to the rear wall portion.

9. A personal watercraft comprising:

a watercraft body including a hull and a deck provided on the hull;

a handlebar rotatably disposed relative to the watercraft body;

a straddle seat disposed on the deck at a rearward location of the handlebar; and a storage container attached to the watercraft body, the storage container including an access opening that opens upward relative to the deck, and a sidewall surrounding an interior storage space, the sidewall having an upper end and a lower end, with the interior storage space between the upper end and the lower end, the lower end of the sidewall defining a bottom opening with a cross sectional area that is larger than a cross sectional area of the upper end of the sidewall, the storage container being located between the handlebar and the straddle seat, the sidewall including a front wall portion that faces the handlebar and a rear wall portion that faces the straddle seat, the front wall portion being inclined relative to the rear wall portion, and the front wall portion being inclined relative to the rear wall portion such that the lower end of the sidewall at the front wall portion is disposed farther from the lower end of the sidewall at the rear wall portion than is the upper end of the sidewall at the front wall portion with respect to the upper end of the sidewall at the rear wall portion.

10. A personal watercraft comprising:

a watercraft body including a hull and a deck provided on the hull;

a handlebar rotatable disposed relative to the watercraft body;

a straddle seat disposed on the deck at a rearward location of the handlebar; and a storage container attached to the watercraft body, the storage container including an access opening that opens upward relative to the deck, and a sidewall surrounding an interior storage space, the sidewall having an upper end and a lower end, with the interior storage space between the upper end and the lower end, the lower end of the sidewall defining a bottom opening with a cross sectional area that is larger than a cross sectional area of the upper end of the sidewall, the storage container being located between the handlebar and the straddle seat, the sidewall including a front wall portion that faces the handlebar and a rear wall portion that faces the straddle seat, the front wall portion being inclined relative to the rear wall portion, and the lower end of the sidewall at the front wall portion being disposed forward relative to the upper end of the sidewall at the front wall portion.

11. The personal watercraft according to claim 1, further comprising a lid movably coupled to one of the storage container and the watercraft body between an opened position that exposes the access opening and a closed position that covers the access opening.

12. The personal watercraft according to claim 11, wherein the lid is configured to open such that the access opening opens rearward.

13. The personal watercraft according to claim 11, wherein the lid is movably coupled to the watercraft body.

14. The personal watercraft according to claim 1, wherein the storage container includes a top wall connected to the sidewall, the top wall defining the access opening.

15. A personal watercraft comprising:

a watercraft body including a hull and a deck provided on the hull;

a handlebar rotatably disposed relative to the watercraft body;

a straddle seat disposed on the deck at a rearward location of the handlebar; and a storage container attached to the watercraft body, the storage container including an access opening that opens upward relative to the deck, and a sidewall surrounding an interior storage space, the sidewall having an upper end and a lower end, with the interior storage space between the upper end and the lower end, the lower end of the sidewall defining a bottom opening with a cross sectional area that is larger than a cross sectional area of the upper end of the sidewall, the sidewall includes at least one mounting flange extending outwardly with respect to the interior storage space, the at least one mounting flange being secured to one of the deck and the hull.

16. The personal watercraft according to claim 15, wherein the at least one mounting flange includes four mounting flanges that are each fastened to the one of the deck and the hull.

17. The personal watercraft according to claim 15, wherein the at least one mounting flange is fastened to the deck.

18. The personal watercraft according to claim 1, further comprising a control member pivotally mounted to the sidewall.

19. The personal watercraft according to claim 18, further comprising a jet propulsion unit disposed on the hull, the control member being operatively coupled to the jet propulsion unit.

20. A watercraft comprising:

a watercraft body including a hull and a deck provided on the hull; and a storage container attached to the watercraft body, the storage container including an access opening that opens upward relative to the deck, and a sidewall surrounding an interior storage space, the sidewall having an upper end and a lower end, with the interior storage space between the upper end and the lower end, the access opening being disposed in the upper end which is spaced vertically above the lower end with the watercraft in a horizontal position, the lower end of the sidewall defining a bottom opening with a cross sectional area that is larger than a cross sectional area of the upper end of the sidewall, the bottom opening and the access opening being disposed at opposite end walls of the storage container.

21. The personal watercraft according to claim 1, wherein the access opening is disposed in the upper end which is spaced vertically above the lower end while the watercraft is in an upright riding position in which the watercraft is floating on a calm body of water.

* * * * *